US005197113A

United States Patent [19]

Mumolo

[11] Patent Number: 5,197,113

[45] Date of Patent: Mar. 23, 1993

[54] METHOD OF AND ARRANGEMENT FOR DISTINGUISHING BETWEEN VOICED AND UNVOICED SPEECH ELEMENTS

[75] Inventor: Enzo Mumolo, Pomerzia, Italy

[73] Assignee: Alcatel N.V., Amsterdam, Netherlands

[21] Appl. No.: 524,297

[22] Filed: May 15, 1990

[30] Foreign Application Priority Data

May 15, 1989 [IT] Italy ..... 20505 A/89

[51] Int. Cl.[5] ..... G10L 9/00

[52] U.S. Cl. ..... 395/2

[58] Field of Search ..... 381/36-46, 381/47-49, 50; 364/513.5

[56] References Cited

U.S. PATENT DOCUMENTS

| | | | |
|---|---|---|---|
| 3,679,830 | 7/1972 | Uffelman et al. | 381/50 |
| 4,164,626 | 8/1979 | Fette | 381/49 |
| 4,589,131 | 5/1986 | Horvath et al. | 381/38 |
| 4,627,091 | 12/1986 | Fedele | 381/41 |
| 4,637,046 | 1/1987 | Sluijter et al. | 381/49 |
| 4,817,159 | 3/1989 | Hoshimi et al. | 381/43 |

FOREIGN PATENT DOCUMENTS 0092611 2/1983 European Pat. Off. .

OTHER PUBLICATIONS

Parsons, Thomas W., *Voice and Speech Processing*, 1986, pp. 197-209, McGraw-Hill Book Co.

"Improvement of Voicing Decisions by Use of Context", E. P. Neuburg, *International Conference on Acoustics, Speech & Signal Processing*, Tulsa OK, Apr. 10-12, 1978, pp. 5-7.

"The Voiced/Unvoiced Detector", F. Visser, *Elektor*, vol. 7, No. 2, Feb. 1981, pp. 17-25.

"Reliable Voiced/Unvoiced Decision", S. G. Knorr, *IEEE Transactions on Acoustics, Speech and Signal Processing*, vol. ASSP-27, No. 3, Jun. 1979, pp. 263-267.

*Primary Examiner*—Michael R. Fleming
*Assistant Examiner*—Michelle Doerrler
*Attorney, Agent, or Firm*—Ware, Fressola, Van Der Sluys & Adolphson

[57] ABSTRACT

In distinguishing between voiced and unvoiced speech elements use is made of the fact that the spectra of voiced sounds lie predominantly at or below about 1 kHz, and the spectra of unvoiced sounds lie predominantly at or above about 2 kHz. A change from a voiced sound to an unvoiced sound or vice versa always produces a clear shift of the spectrum, and that without such a change, there is no such clear shift. From the lower- and higher-frequency energy components, a measure of the location of the spectral centroid is derived which is used for a first decision. Based on the difference between two successive measures, a second decision is made by which the first can be corrected.

14 Claims, 2 Drawing Sheets

METHOD OF AND ARRANGEMENT FOR DISTINGUISHING BETWEEN VOICED AND UNVOICED SPEECH ELEMENTS

BACKGROUND OF THE INVENTION

1. Field of the Invention

The present invention relates to a method and apparatus for distinguishing between voiced and unvoiced speech elements and more particularly to a method and apparatus wherein a measure of the location of the spectrum of the speech element is determined.

2. Description of the Prior Art

Speech analysis, whether for speech recognition, speaker recognition, speech synthesis, or reduction of the redundancy of a data stream representing speech, involves the step of extracting the essential features, which are compared with known patterns, for example. Such speech parameters are vocal tract parameters, beginnings and endings of words, pauses, spectra, stress patterns, loudness; general pitch, talking speed, intonation, and not least the discrimination between voiced and unvoiced sounds.

The first step involved in speech analysis is, as a rule, the separation of the speech-data stream to be analyzed into speech elements each having a duration of about 10 to 30 ms. These speech elements, commonly called "frames", are so short that even short sounds are divided into several speech elements, which is a prerequisite for a reliable analysis.

An important feature in many, if not all languages is the occurrence of voiced and unvoiced sounds. Voiced sounds are characterized by a spectrum which contains mainly the lower frequencies of the human voice. Unvoiced, crackling, sibilant, fricative sounds are characterized by a spectrum which contains mainly the higher frequencies of the human voice. This fact is generally used to distinguish between voiced and unvoiced sounds or elements thereof. A simple arrangement for this purpose is given in S. G. Knorr, "Reliable Voiced-/Unvoiced Decision", IEEE Transactions on Acoustics, Speech, and Signal Processing, VOL. ASSP-27, No. 3, June 1979, pp. 263–267.

It is also known, however, that the location of the spectrum alone, characterized, for example, by the location of the spectral centroid, does not suffice to distinguish between voiced and unvoiced sounds, because in practice, the boundaries are fluid. From U.S. Pat. No. 4,589,131, corresponding to EP-B1-0 076 233, it is known to use additional, different criteria for this decision.

SUMMARY OF THE INVENTION

It is the object of the invention to make the decision more reliable without having to evaluate the speech elements for any further criteria.

This object is attained by a method wherein for each speech element a measure of the location of the spectrum of the element is determined, and that for successive speech elements a measure of the magnitude of the shift between the spectra is additionally determined, and a decision between voiced and unvoiced speech elements is made based on both measures. The method is implemented by an apparatus for distinguishing between voiced and unvoiced speech elements, said apparatus having a first unit for determining a measure of the location of the spectrum of an element, and a second unit is provided for determining a measure of the magnitude of the shift between the spectra of successive speech elements, and a decision logic unit is provided for evaluating the two measures to decide between voiced and unvoiced speech elements.

The invention is predicated on the fact that a change from a voiced sound to an unvoiced sound or vice versa normally produces a clear shift of the spectrum, and that without such a change, there is no such clear shift.

To implement the invention, a measure of the location of the spectral centroid is derived from the lower- and higher-frequency energy components (below about 1 kHz and above about 2 kHz, respectively) and used for a first decision. Based on the difference between two successive measures, a second decision is made by which the first can be corrected.

DESCRIPTION OF THE DRAWINGS

An embodiment of the invention will now be explained in greater detail with reference to the accompanying drawings, in which.

DETAILED DESCRIPTION OF THE PREFERRED EMBODIMENT

Figure 1:
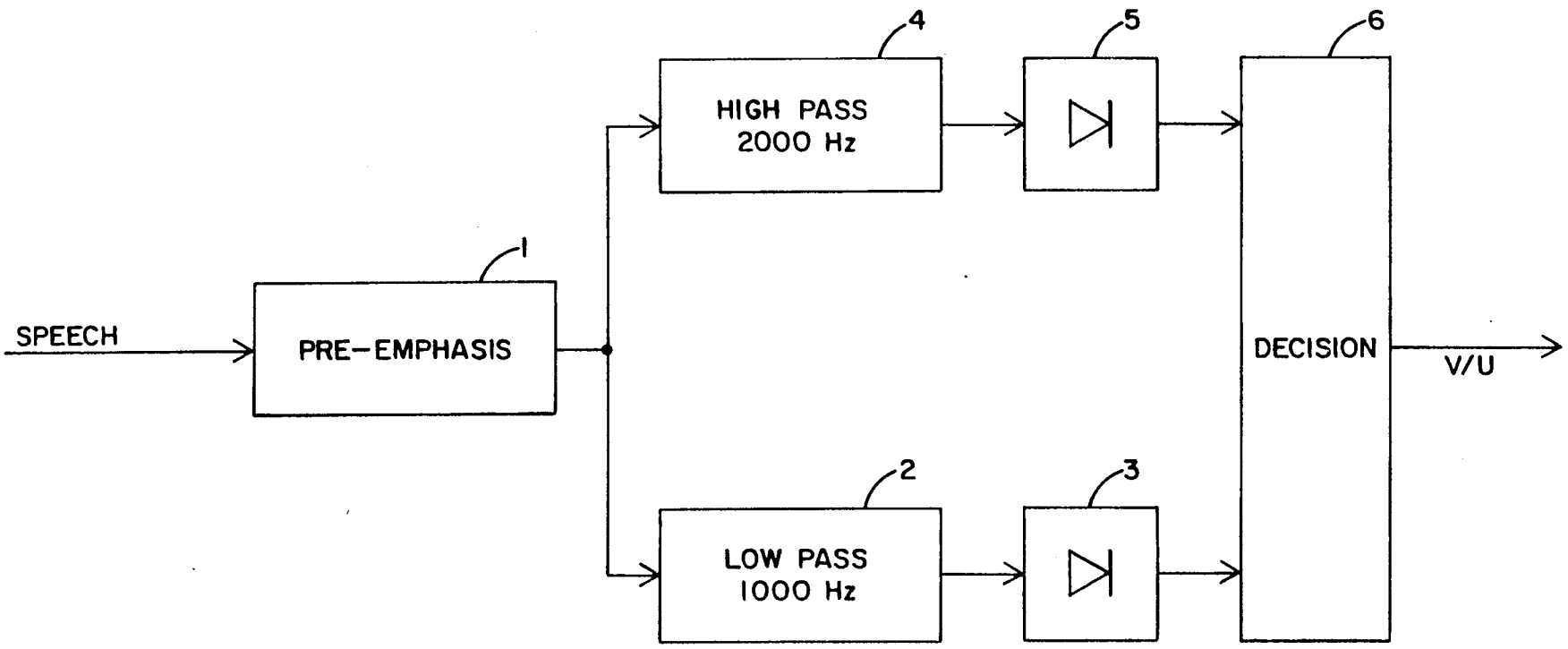
FIG. 1 is a block diagram of an apparatus for distinguishing between voiced and unvoiced speech elements.

At an input, the apparatus has a pre-emphasis network 1, as is commonly used at the inputs of speech analysis systems. Connected in parallel to the output of this pre-emphasis network are the inputs of a low-pass filter 2 with a cutoff frequency of 1 kHz and a high-pass filter 4 with a cutoff frequency of 2 kHz. The low-pass filter 2 is followed by a demodulator 3, and the high-pass filter 4 by a demodulator 5. The outputs of the two demodulators are fed to an evaluating circuit 6, which derives a logic output signal v/u (voiced/unvoiced) therefrom.

The output of the demodulator 3 thus provides a signal representative of the variation of the lower-frequency energy components of the speech input signal with time. Correspondingly, the output of the demodulator 5 provides a signal representative of the variation of the higher-frequency energy components with time.

Speech analysis systems usually contain pre-emphasis networks w if implemented in digital form, realize the function $f(z)—1—uz^{-1}$, where u ranges typically from 0.94 to 1. Tests with the two values $u=0.94$ and $u=1$ have yielded the same satisfactory results. The low-pass filter 2 is a digital Butterworth filter; the high-pass filter 4 is a a digital Chebyshev filter; the demodulators 3 and 5 are square-law demodulators.

The simplest case of the evaluation of these energy components is the usual case in the prior art, where the evaluating circuit is a comparator which indicates voiced speech if the lower-frequency energy component predominates, and unvoiced speech if the higher-frequency energy component predominates. However, it is common practice, on the one hand, to weight the energies logarithmically and, on the other hand, to form the quotient of the two values, and to use a decision logic with a fixed threshold, e.g. a Schmitt trigger. In the invention, such an evaluation is assumed, but it is supplemented. The quotient used in the following is the value $R=10$ log (low-pass energy/high-pass energy).

The following assumes that processing is performed discontinuously, i.e., that 16-ms speech segments are considered. This is common practice anyhow. Then, each quotient, formed as described above, is stored until the next quotient is received. Quotients in analog form are stored in a sample-and-hold circuit, and quotients in digital form in a register. The two successive quotients are then subtracted one from the other, and the absolute value of the result is formed. Both analog and digital subtractors are familiar to anyone skilled in the art. If the result is in analog form, the absolute value is obtained by rectification; if the result is in digital form, the absolute value is obtained by omitting the sign. This absolute value will hereinafter be referred to as "Delta".

One possibility of obtaining a definitive voiced/unvoiced decision from the values R and Delta will now be described with the aid of FIG. 2. The algorithm used is very simple as it requires only few comparisons, but it has proved sufficient in practice.

First, an initial decision is made using the value of R. If R is greater than a first threshold Thr1, the current frame will initially be set to voiced; otherwise, it will be set to unvoiced.

If the current frame was classified as unvoiced, and if the previous frame was voiced, a voiced/unvoiced transition may have occurred. If the previous frame was voiced, Delta will be tested in order to confirm or not the hypothesis voiced/unvoiced. If Delta is less than a second threshold Thr2, it is most likely that a voiced/voiced transition has occurred, so that the current frame will be set to voiced.

Some similar process occurs when the current frame resulted, as a first decision, voiced. If Delta is less than a third threshold Thr3, it is almost impossible that an unvoiced/voiced transition took place. Therefore, in this case, the decision concerning the current frame is changed, and it is taken as unvoiced.

Preferred threshold values are Thr1 = −1, Thr2 = +6, and Thr3 = +4. Possible ranges for the threshold values are Thr1 = −2.5 to +0.5, Thr2 = +5 to +8, and Thr3 = +3 to +6. These threshold values are the results of tests with speech limited to the telephone frequency range extending up to 4 kHz and with Italian words. When using other languages or a different frequency range these threshold values should perhaps be slightly changed.

Finally, a brief explanation regarding the use of the two measures R and Delta.

The values of R are distributed in different ranges depending on the fact that it is computed on voiced or unvoiced frames. But the distributions are partially overlapped, so the discrimination cannot be based on this parameter itself. The two distributions int -sect at a value of about −1.

The discrimination algorithm is based on the observation that the Delta shows a typical distribution which depends on the transition that occurred (for example, it is different for a voiced/voiced and for a voiced/unvoiced transition).

In a voiced/voiced transition (i.e. when we pass from one voiced frame to another voiced frame), Delta is mostly concentrated in the range 0 . . . 6 and for voiced/unvoiced transitions Delta is mostly distributed outside that interval. On the other hand, in unvoiced/voiced transitions Delta is located, most of the times, above the value 4.

Figure 2:
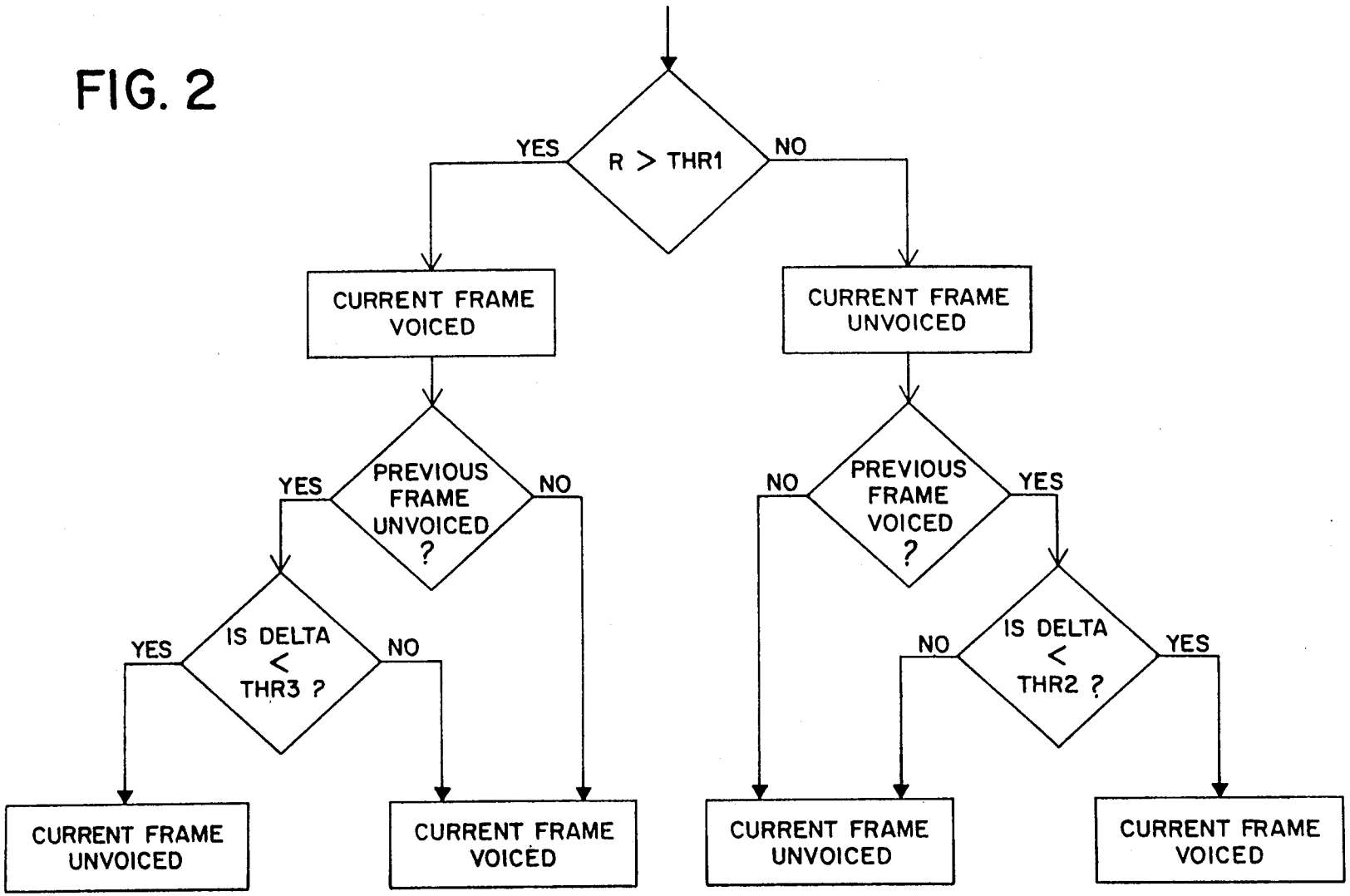
FIG. 2 is a flowchart representing one possible mode of operation of the evaluating circuit of FIG. 1.

The algorithm described with the aid of FIG. 2 can be implemented in the evaluating circuit 6 in various ways (with analog, digital, hard-wired , under computer control). In any case, a person skilled in the art will have no difficulty finding an appropriate implementation.

Besides the algorithm described with the aid of FIG. 2, further possibilities of evaluating the two measures are conceivable. For example, not only two, but several successive segments may be evaluated, taking into account that if the speech is separated into 16-ms segments, about 10 to 30 successive decisions result for each sound.

At least the evaluating circuit 6 is preferably implemented with a program-controlled microcomputer. The demodulators and filters may be implemented with microcomputers as well. Whether two or more microcomputers or only one microcomputer are used and whether any further functions are realized by the microcomputer(s) depends Dn the efficiency, but also on the programming effort.

If the arrangement operates digitally under program control, the spectrum of the speech signal cay also be evaluated in an entirely different manner. It is possible, for example, to split each 16-ms segment into its spectrum according to Fourier and then cetermine the centroid of the spectrum. The location of the centroid then corresponds to the quotient mentioned above, which is nothing but a coarse approximation of the location of the spectral centroid. This spectrum may also, of course, be used for the other tasks to be performed during speech analysis.

What is claimed is:

1. Method of distinguishing between voiced and unvoiced speech elements in a sequence of successive speech elements, wherein for each speech element a measure of the location of a spectrum is determined, characterized in that for successive speech elements a measure of the magnitude of the shift between the spectra is additionally determined, and that for the decision between voiced and unvoiced speech elements, both measures are used and a voiced or unvoiced decision is outputted.

2. A method as claimed in claim 1, characterized in that a measure of the location of the spectrum is derived from a ratio between energy contained in a lower-frequency spectral range and energy contained in a higher-frequency spectral range.

3. A method as claimed in claim 2, characterized in that the lower-frequency range extends to about 1 kHz, and that the higher-frequency range lies above about 2 kHz.

4. A method as claimed in claim 1, wherein the step of determining a measure of the location of the spectrum is characterized in that the speech element is transformed into the frequency domain, and that the centroid of the spectrum is determined and serves as the measure of the location of the spectrum.

5. An apparatus for distinguishing between voiced and unvoiced speech elements in a sequence of successive speech elements, comprising a unit for determining a first measure of the location of a spectrum for each speech element, characterized in that in addition, there is provided a unit for determining a second measure of the magnitude of a shift between the spectra of successive speech elements, and that a decision logic is provided which uses the two measures to determine if the speech element is voiced or unvoiced and to output said decision.

6. An apparatus as claimed in claim 5, characterized in that the unit for determining measure of the location of the spectrum contains two branches connected in parallel at an input, that one of the branches has high-pass filter characteristics and the other low-pass filter characteristics, that both branches contain devices for determining energy contents of signals from the filters, that each of the two branches terminates at an input of a divider whose output represents the first measure, and that the unit for determining the measure of the magnitude of the shift of the spectra contains a storage element for storing the first measure of a speech element and a subtractor for subtracting the first measure of a successive speech element from the stored first measure of said speech element.

7. An apparatus as claimed in claim 6, characterized in that the branch with high-pass filter characteristics contains a high-pass filter with a cutoff frequency of about 2 kHz, that the branch with low-pass filter characteristics contains a low-pass filter with a cutoff frequency of about 1 kHz, and that the two branches are preceded by a common pre-emphasis network.

8. An apparatus as claimed in claim 7, characterized in that the apparatus is implemented, wholly or in part, with a program-controlled microcomputer.

9. An apparatus as claimed in claim 6, characterized in that the apparatus is implemented, wholly or in part, with a program-controlled microcomputer.

10. An apparatus as claimed in claim 5, characterized in that it is implemented, wholly or in part, with a program-controlled microcomputer.

11. An apparatus as claimed in claim 5, characterized in that the apparatus includes a program-controlled microcomputer, and that said microcomputer transforms the speech elements into the frequency domain, and determines the centroid of the spectrum of each speech element which serves as the first measure of the location of a spectrum.

12. An apparatus for distinguishing between voiced and unvoiced speech elements in a sequence of successive speech elements, comprising a unit for determining a first measure of the location of a spectrum for each speech element, characterized in that in addition, there is provided a unit for determining a second measure of the magnitude of a shift between the spectra of successive speech elements, and that a decision logic is provided which uses the two measures to determine if the speech element is voiced or unvoiced and to output said decision and further characterized in that the unit for determining measure of the location of the spectrum contains two branches connected in parallel at an input, that one of the branches has high-pass filter characteristics and the other low-pass filter characteristics, that both branches contain devices for determining energy contents of signals from the filters, that each of the two branches terminates at an input of a divider whose output represents the first measure, and that the unit for determining the measure of the magnitude of the shift of the spectra contains a storage element for storing the first measure of a speech element and a subtractor for subtracting the first measure of a successive speech element from the stored first measure of said speech element.

13. An arrangement as claimed in claim 12, characterized in that the branch with high-pass filter characteristics contains a high-pass filter with a cutoff frequency of about 2 kHz, that the branch with the low-pass filter characteristics contains a low-pass filter with a cutoff frequency of about 1 kHz, and that the two branches are preceded by a common pre-emphasis network.

14. An apparatus as claimed in claim 13, characterized in that the apparatus is implemented, wholly or in part, with a program-controlled microcomputer.

* * * * *